United States Patent [19]

Roberts

[11] 4,143,411

[45] Mar. 6, 1979

[54] ARCHITECTURAL LIGHTING APPARATUS

[76] Inventor: Thomas E. Roberts, 4501 N. Western, Oklahoma City, Okla. 73118

[21] Appl. No.: 757,467

[22] Filed: Jan. 7, 1977

[51] Int. Cl.[2] ..... F21S 1/02

[52] U.S. Cl. ..... 362/145; 362/146; 362/234; 362/252; 362/362; 362/806

[58] Field of Search ..... 362/268, 270, 272, 291, 362/806, 278, 145, 146, 234, 252, 362

[56] References Cited

U.S. PATENT DOCUMENTS

| | | | |
|---|---|---|---|
| 2,532,528 | 12/1950 | Zuley | 362/404 |
| 3,377,488 | 4/1968 | Lorenzo | 362/404 |
| 3,714,414 | 1/1973 | Sternius | 362/806 |

*Primary Examiner*—Stephen J. Lechert, Jr.
*Attorney, Agent, or Firm*—Robert M. Hessin

[57] ABSTRACT

Lighting apparatus for architectural usage wherein the lighting structure can be permanently placed in predetermined disposition to render relatively trouble-free and long service life. The apparatus consists of a tubular lighting element, which can be fabricated in any desired length of whatever the selected wattage rating, that is utilized in combination with a seating structure that may be permanently secured in or about the architectural structure utilizing such lighting design. The lighting element consists of a clear tube containing a selected plurality of low wattage light bulbs as used in combination with a retaining structure which is adapted for captive retention within a molded cementitious structure of the like, while defining a groove or insert portion for selective retention of the lighting element thereby to focus or direct light at selected angles to illuminate the desired surface or area.

12 Claims, 9 Drawing Figures

24 VOLT
A-C
SOURCE

ARCHITECTURAL LIGHTING APPARATUS

BACKGROUND OF THE INVENTION

1. Field of the Invention

The invention relates generally to illumination apparatus and, more particularly, but not by way of limitation, it relates to improved lighting apparatus which is particularly adapted for architectural usage.

2. Description of the Prior Art

The prior art includes numerous types of illuminating source and reflective structures which provide directed or diffused light for diverse purposes and functions. Prior approaches to illumination of outdoor facilities, e.g. stepways and outdoor plaza environs, has generally been approached utilizing directive spotlights or other forms of localized illumination sources such that uniform illumination of such as stepways has not been achieved in optimum manner. Some attempts at more uniform illumination have been made but these are generally lacking in service reliability and long life, and failure of such exigent factors tends to render their application of questionable benefit.

SUMMARY OF THE INVENTION

The present invention contemplates apparatus for architectural usage wherein a linear light source of any selected length may be utilized in conjunction with a retaining structure which can be permanently placed in whatever the desired attitude within a selected planar structure or the like. In a more limited aspect, the invention consists of electrical illumination circuitry consisting of a plurality of lamp bulbs in selected parallel-series configuration, as energized preferably by a low voltage source; the length of light source is then disposed within a clear, flexible tubing which is specifically adapted for coactive combination with a structure which readily adapts for affixure to or recessed retention in a supporting structure.

Therefore, it is an object of the present invention to provide illumination apparatus for use in architectural applications to function with long life of trouble-free service.

It is also an object of the invention to provide illuminating apparatus which may be formed in any selected length for application to a particular architectural specification.

It is yet another object of the present invention to provide uniform illuminating apparatus for use in architectural applications of both linear and curvi-linear dimension.

Finally, it is an object of the present invention to provide permanent outdoor lighting apparatus for particular usage on stepways and the like wherein uniform step lighting is achieved with much extended time of service reliability.

Other objects and advantages of the invention will be evident from the following detailed description when read in conjunction with the accompanying drawings which illustrate the invention.

DETAILED DESCRIPTION OF THE INVENTION

Figures 1, 2, 3, 4, 5:
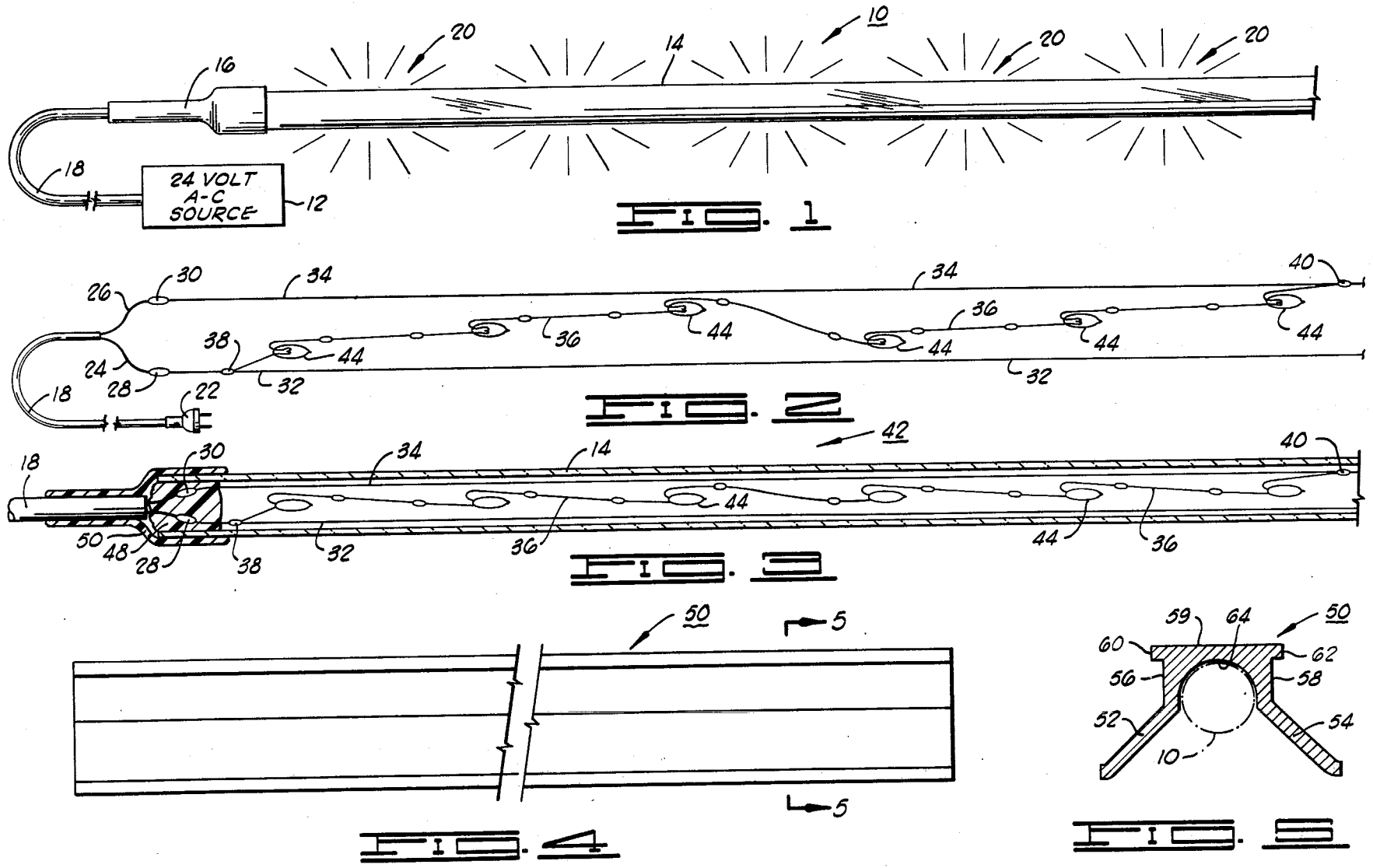
FIG. 1 is a plan view of a lighting element of the type which is used in the present invention.
FIG. 2 is a schematic diagram of the electrical portion of a preferred form of lighting element as utilized in the present invention.
FIG. 3 is a vertical section through a portion of a preferred form of lighting element such as that shown schematically in FIG. 2.
FIG. 4 is a view in side elevation of retaining structure utilized in combination with the lighting element as shown in FIG. 1.
FIG. 5 is a section taken along line 5—5 of FIG. 4.

FIG. 1 illustrates a lighting element 10 which may be constructed for energization by a particular low voltage source, e.g., 24 volt alternating current source 12. Thus, lighting element 10 consists of a light tube 14 which is of flexible, transparent material and a length as required for particular architectural application. A connector 16 provides rigid electrical connection to one end of light tube 14, as supplied via a suitable conductor 18 from 24 A-C source 12. The 24 volt A-C may be supplied from the A-C power on the premises by means of step-down transformer or the like, much on the order of telephone power generation. In operation, the light tube 14 contains a plurality of lamp bulbs in-line along the length thereof to provide a desired plurality of illumination sources 20, the number and spacing of which are design criteria.

FIG. 2 illustrates in schematic form the electrical interconnection within one form of lighting element. A suitable plug 22 or other specialized connector provides power input for conduction via wire connector 18 such that two-pair conductors 24 and 26 extend to respective connectors 28 and 30 which are securely affixed in conductive manner to buss leads 32 and 34. Connectors 28 and 30 may be any of such as solder or crimp connections; however, due to the close tolerances and minute character of lamps and wiring, it has proven that simple solder connections are most efficient and economical of manufacture. The buss leads 32 and 34 are each of conventional enameled copper conductor which provides insulation yet can be prepared for solder connection, i.e., similar to the well-known forms of transformer wire. The buss leads 32 and 34 in present operative models are on the order of 5 to 10 thousandths diameter.

The parallel buss leads 32 and 34 then provide power connection along the length of the interior of light tube 14 and may receive a plurality of series lamp connections of selected number and spacing, depending upon the desired effect and lighting power. Thus, a plurality of lamp segments 36 are connected as by soldering at opposite end joints 38 and 40 for energization by buss leads 32 and 34. In the particular case, each lamp segment 36 consists of six series lamps 44 but, to reiterate, the number of lamps as well as the lamp spacing of lamp segments 36 may be varied to design specification.

The lamps 44 as presently preferred are 0.4 watt incandescent bulbs, approximately one-quarter inch in length, and such lamps when used in series of five or six with the 24 volt A-C source have extremely long lifetime while providing sufficient illumination. The lamps 44 may be spaced as close as one inch apart with up to six lamps in each series lamp segment 36. In determining power requirements at installation, it is the general rule to allow one watt for each two lamp bulbs in the overall system and, since we are dealing with 0.4 watt bulbs, there is a built in safety factor which tends to greatly decrease possibility of bulb failure thereby to extend the trouble-free life of each lighting element 10.

FIG. 3 illustrates a lighting element 42 in section to show the disposition of the actual wiring within lighting tube 14. This preferred form of lighting element 42 is commercially available at design specification from Tivoli Industries, Inc. of Santa Ana, Calif. The lighting tube 14 is constructed of LEXAN transparent tubular material, a commercially available resin product, which is particularly adaptable for its light transmissive properties as well as its flexibility for disposition along curves or other tortuous routing. The buss leads 32 and 34, as well as each of series lamp segments 36, are disposed in extension through light tube 14 with connection being made at connectors 28 and 30 to the two wire pair within connector 18 at the tube source end. A plastic sealant material 48 then serves to seal the tube source end as well as to bind the wire connectors 28 and 30 in proper placement. In present practice, the sealant 48 may be such as silicon epoxy sealant which is commercially available from General Electric Company. For additional strength and rigidity, plastic sleeve 50, e.g., polyvinyl chloride, is tightly shrunk over the source end tube joint. The sleeve 50 is tight fitting about both the end of tube 14 as well as the outer insulation of conductor 18 to provide a rigid, durable interconnection.

FIGS. 4 and 5 illustrate one form of retaining structure 50 which is used in the present invention in combination with lighting element 10. The retaining structure 50 may be formed of various suitable materials, e.g., aluminum, plastic or the like, and the retaining structure 50 serves to retain the lighting element 10 in a desired lighting attitude, as will be further described. Retaining structure 50 may be of any desired length, depending upon the length of lighted surface desired, and it has uniform cross-section such as shown in FIG. 5. Thus, retaining structure 50 is formed with bifurcated flanges 52 and 54 disposed at approximately 90° with respect to one another and extending equi-angularly outward from the sides 56 and 58. It should be noted that bifurcated flanges 52 and 54 may not be symmetrical in some applications to achieve particular lighting effects. The upper surface 59 is of flat formation but extending lateral flanges 60 and 62 outward for the purpose of gripping within molded or otherwise formed material.

By the same token, upper surface 59 may also serve as a bonding surface for use in those applications where retaining structure 50 is bonded to its support surface. An inner circular cavity 64 is then formed between bifurcated flanges 52 and 54 for the purpose of receiving lighting element 10 upward therein. Lighting element 10 may be retained within cavity 64 by means of clear epoxy sealant such as the aforementioned General Electric silicon sealant.

Figure 6:
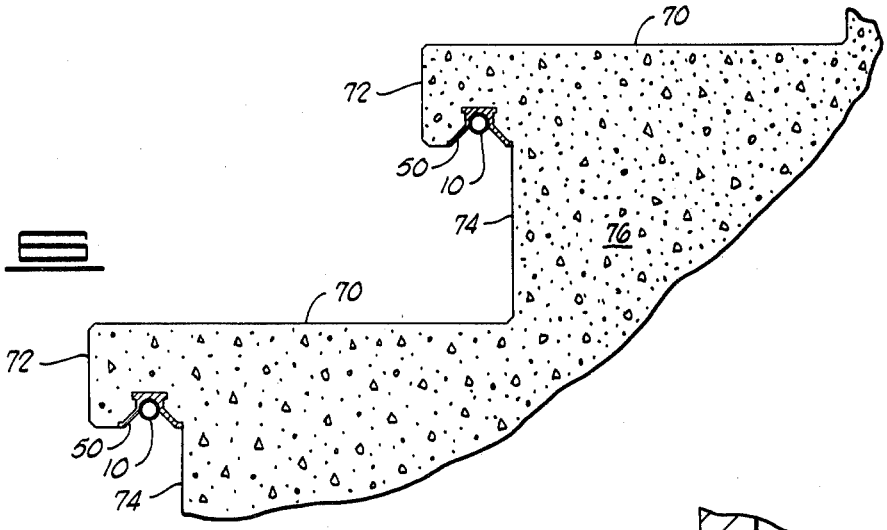
FIG. 6 is a section through plural mold-formed steps which include the lighting apparatus of the present invention.
Figure 7:
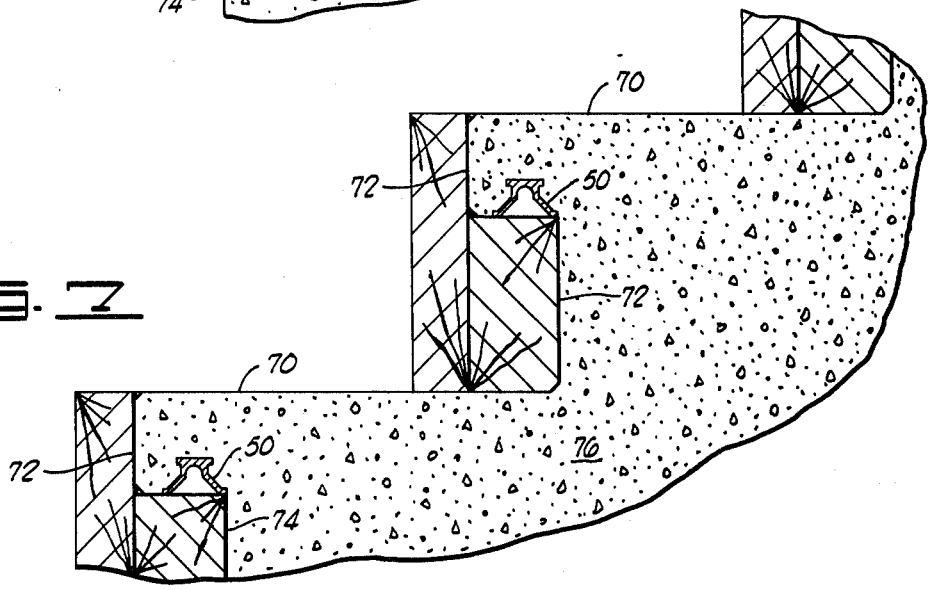
FIG. 7 depicts a similar section of mold-formed steps illustrating the positioning of retaining structure during pouring and formation of the steps.

FIG. 6 illustrates the manner of utilizing the light apparatus in a step-way structure. Thus, each of steps 70 is formed with an overhang 72 and riser portion 74. The retaining structure 50 is pre-positioned for retention within the lower surface of overhang 72 during the molding procedure in forming steps 70. As shown in FIG. 7, the retaining structures 50 are placed in position and tacked or taped securely to the underlying mold structures prior to pouring of the cementitious material 76, e.g., concrete, terrazzo or equivalent materials. After cementitious material 76 has cured, the wooden forms may be removed and the numerous retaining structures 50 will be securely retained within the step material as aided by their respective retention flanges 60 and 62 (FIG. 5).

The lighting elements 10 may be permanently bonded within respective retaining structures 50 either before or after the pouring of mold material, depending upon particular construction specifications. In either event, the lighting element 10 is securely retained at an apical position relative to the inner sides of bifurcated flanges 52 and 54 (FIG. 5) which serve as reflective, light-directing structures to provide uniform lighting across each step 70. It should be understood that no matter what the length of the step, the individual lighting elements 10 and their interior series lighting segments 36, of selected number and spacing, may be so arranged to provide nearly uniform illumination along the length. It should be understood that, while particular reference and illustration is made to step-ways, the light apparatus combination may be used in numerous architectural applications to achieve unusual light effects on or about a building, home or like structure.

Figure 8:
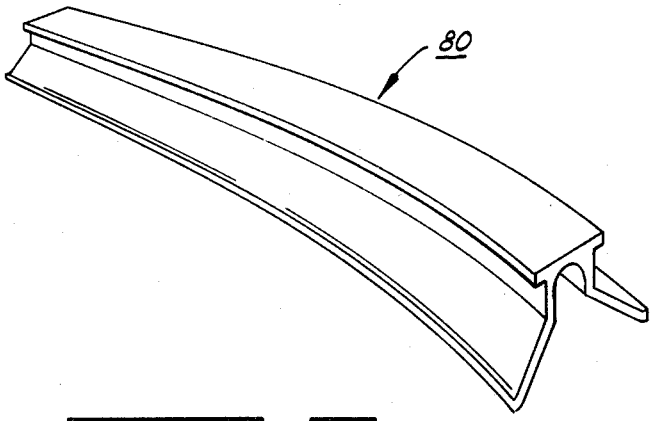
FIG. 8 is a view in perspective of yet another form of retaining structure as constructed in accordance with the present invention.
Figure 9:
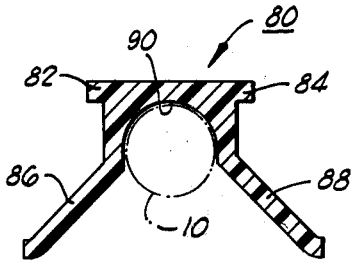
FIG. 9 is a cross-section through the retaining structure of FIG. 8.

FIG. 8 illustrates an alternative form of retaining structure 80, which as shown in FIG. 9 has the same cross-section as retaining structure 50, but the structure 80 is specifically formed of an extrudable, light-reflective plastic such as polyvinyl chloride. The retaining structure 80 then has the capability of being bent for placement in steps, walls and the like which have curving, serpentine or other tortuous configurations; since, the LEXAN-constructed lighting tube 14 can be easily bent for mating engagement and retention therein. The cross-section of the retaining structure 80 is again similar having the laterally extending retaining flanges 82 and 84 while extending the similar angularly extended bifurcated flanges 86 and 88 below a tube retaining cavity 90. The retaining structure 80 is preferably formed of plastic material of silvered or white coloration such that it has good reflective and light-directing capabilities.

The foregoing discloses a novel architectural lighting apparatus which may be suitably mounted to provide uniform illumination of edifice and landscape structures while offering the advantage of reliable, long life installation. The illumination apparatus functions with relatively low electrical power consumption, and an overall lighting system for diverse decorative lighting arrangements is easily constructed utilizing the similar materials and design principles in each case. While A-C power is alluded to, it should be well-known that D-C energization can also be used with attendant interchange of lamps.

Changes may be made in the combination and arrangement of parts as heretofore set forth in the specification and shown in the drawings; it being understood that changes may be made in the embodiments disclosed without departing from the spirit and scope of the invention as defined in the following claims.

What is claimed is:

1. Illumination apparatus combining a lighting element and retaining structure, comprising:

transparent tubular means of selected length;

first and second buss wires extending throughout said tubular means;

a plurality of segments of series-connected plural incandescent lamps with each segment connected between said first and second buss wires, said lamps being equi-spaced along said tubular means;

an electrical source energizing said first and second buss wires;

rigid seating means of selected length and uniform cross-section which is formed to have a retaining cavity for receiving, in continuous contacting disposition, approximately one-half the circumfery of said tubular means therein; and means for securing said tubular means within the retaining cavity.

2. Illumination apparatus as set forth in claim 1 wherein said rigid seating means further includes:

angularly disposed flanges extending from opposite sides of said retaining cavity and laterally opposed flanges extending outward from said seating element.

3. Illumination apparatus as set forth in claim 1 wherein:

said rigid seating means is unitarily formed from plastic material having good light reflection characteristics but sufficient resiliency to enable curvi-linear disposition.

4. Illumination apparatus for use in association with architectural structures, comprising:

a retaining structure of unitary formation and selected length having a cross-section defining opposed lateral flanges co-planar with an upper surface, and extending bifurcated flanges oppositely outward with each at an angle of approximately 45° to the plane of the upper surface, while defining a cavity at said bifurcation;

lighting means of said selected length secured contiguously to the extent of approximately one-half of its circumfery within said cavity; and means for energizing said lighting means to provide illumination along the length thereof.

5. Illumination apparatus as set forth in claim 4 which is further characterized in that:

said retaining structure is extruded and has uniform cross-section along the entire length.

6. Illumination apparatus as set forth in claim 5 wherein:

said retaining structure is extruded from flexible plastic material.

7. Illumination apparatus as set forth in claim 4 wherein said lighting means comprises:

tubular means containing a plurality of plural lamp series segments, each of said segments being connected in parallel, and said total number of lamps being arrayed in consecutive, equi-spaced disposition along the length of said tubular means.

8. Illumination apparatus as set forth in claim 7 wherein:

each of said lamps is of fractional wattage and said means for energizing is a low voltage alternating current.

9. An architectural illumination apparatus adapted for use with mold-formed cementitious materials, comprising:

a retaining structure of unitary formation and selected length having a cross-section defining opposed lateral flanges co-planar with a flat surface which are formed to be held in interlocked retention within said cementitious material while exposing a cavity outward therefrom; and lighting means of said selected length disposed to the extent of approximately one-half its circumfery, securely in said retaining structural cavity.

10. An architectural illumination apparatus as set forth in claim 9 wherein said retaining structure cross-section further comprises:

reflective flanges extending outward from each side of said cavity to define a recess for said lighting means.

11. Apparatus as set forth in claim 10 wherein said reflective flanges are disposed at equal but opposite angles relative to the bisector of the cavity and flat surface.

12. Apparatus as set forth in claim 10 wherein said reflective flanges are disposed at different angles relative to the bisector of the cavity and flat surface.

* * * * *